US008794942B2

(12) United States Patent
Schneider et al.

(10) Patent No.: US 8,794,942 B2
(45) Date of Patent: Aug. 5, 2014

(54) VACUUM PUMP WITH CONNECTION NIPPLE FOR CONNECTION BETWEEN A ROTOR SHAFT AND A DRIVE

(75) Inventors: Willi Schneider, Bodelshausen (DE); Bernd Hess, Nürtingen (DE)

(73) Assignee: Joma-Polytec GmbH, Bodelshausen (DE)

( * ) Notice: Subject to any disclaimer, the term of this patent is extended or adjusted under 35 U.S.C. 154(b) by 96 days.

(21) Appl. No.: 13/389,939

(22) PCT Filed: Jul. 14, 2010

(86) PCT No.: PCT/EP2010/060133
§ 371 (c)(1),
(2), (4) Date: Feb. 10, 2012

(87) PCT Pub. No.: WO2011/018294
PCT Pub. Date: Feb. 17, 2011

(65) Prior Publication Data

US 2012/0141313 A1 Jun. 7, 2012

(30) Foreign Application Priority Data

Aug. 12, 2009 (DE) ..... 10 2009 038 132

(51) Int. Cl.
*F03C 2/00* (2006.01)
*F03C 4/00* (2006.01)
*F04C 2/00* (2006.01)

(52) U.S. Cl.
USPC ..... 418/91; 418/94; 418/98; 418/106; 285/397; 285/370; 285/272; 464/11; 464/18

(58) Field of Classification Search
CPC ..... F04C 25/02; F04C 18/344; F04C 29/02; F04C 29/023; F04C 2240/60; F04C 2240/603; F04C 2240/605; F01C 21/0836; F01C 1/344; F16B 7/0413; F16L 21/002; F16L 27/0832; F16L 23/032; F16L 23/02; F16L 23/0283
USPC ..... 418/91, 93–94, 96–100, 106, 253–255, 418/259, 266–268; 285/397, 370, 272; 464/7, 11, 18
See application file for complete search history.

(56) References Cited

U.S. PATENT DOCUMENTS 4,635,972 A * 1/1987 Lyall ..... 285/397
6,106,030 A * 8/2000 Nader et al. ..... 285/368
(Continued)

FOREIGN PATENT DOCUMENTS

CN 101184908 A 5/2008
DE 89 08 863 U1 11/1989
(Continued)

OTHER PUBLICATIONS

Office action dated Jan. 6, 2014 in Chinese appl. No. 201080035739.6 (in Chinese and English translation thereof).

*Primary Examiner* — Theresa Trieu
(74) *Attorney, Agent, or Firm* — Henry M Feiereisen LLC

(57) ABSTRACT

The invention relates to a vacuum pump comprising a cup-shaped housing, a rotor eccentrically mounted for rotation in the housing, and a housing cover closing the cup-shaped housing, wherein the rotor has a rotor shaft that passes through the cup-shaped housing and by which the rotor is driven, wherein the rotor shaft is provided with a bore for delivering a lubricant, and a connection nipple is seated in the free end section of the bore.

9 Claims, 3 Drawing Sheets

(56) References Cited

U.S. PATENT DOCUMENTS

| | | | | |
|---|---|---|---|---|
| 7,007,982 | B2 | 3/2006 | Ishii et al. | |
| 7,628,595 | B2 | 12/2009 | Ono et al. | |
| 2008/0196522 | A1 * | 8/2008 | Eberhardt et al. | 464/18 |

FOREIGN PATENT DOCUMENTS

| | | | |
|---|---|---|---|
| DE | 94 10 508 | U1 | 10/1994 |
| DE | 10 2004 003 567 | A1 | 9/2004 |
| DE | 603 04 004 | T2 | 8/2006 |
| DE | 10 2007 010 729 | B3 | 4/2008 |
| DE | 60 2005 003 339 | T2 | 9/2008 |
| EP | 0 199 984 | A2 | 12/1986 |
| FR | 2 886 696 | A1 | 12/2006 |
| JP | 2004 092 504 | A | 3/2004 |
| JP | 2004-263690 | A | 9/2004 |
| WO | WO 2007/116216 | A1 | 10/2007 |

* cited by examiner

VACUUM PUMP WITH CONNECTION NIPPLE FOR CONNECTION BETWEEN A ROTOR SHAFT AND A DRIVE

CROSS-REFERENCES TO RELATED APPLICATIONS

This application is the U.S. National Stage of International Application No. PCT/EP2010/060133, filed Jul. 14, 2010, which designated the United States and has been published as International Publication No. WO 2011/018294 and which claims the priority of German Patent Application, Serial No. 10 2009 038 132.5, filed Aug. 12, 2009, pursuant to 35 U.S.C. 119(a)-(d).

BACKGROUND OF THE INVENTION

The invention relates to a vacuum pump with a cup-shaped housing, a rotor eccentrically mounted for rotation in the housing, and a housing cover to close the cup-shaped housing, with the rotor having a rotor shaft which traverses the cup-shaped housing and drives the rotor.

Vacuum pumps having such a configuration are known and typically include a housing made of metal in which a rotor is rotatably supported via its rotor shaft and in which the work chambers are formed. The pump compartment is sealed against the atmosphere by pressure-oil lubrication. The rotor shaft is caused to rotate for example by the engine of a motor vehicle, in particular by the camshaft thereof. Lubricating oil is supplied to the vacuum pump via the rotor shaft which is provided for this purpose with an axial bore. To enable introduction of the lubricating oil into the rotor shaft, the drive must be connected with the rotor shaft and in particular with the bore by a suitable means.

The invention is therefore based on the object to provide a vacuum pump which can be reliably connected to an external oil supply in a simple manner.

SUMMARY OF THE INVENTION

This object is solved in accordance with the invention by a vacuum pump of a type described above, having a connection nipple seated in the free end section of the bore of the rotor shaft.

This connection nipple constitutes the connection member between rotor shaft and drive and external lubricating oil supply. The connection nipple is configured in the form of a plug connection. A simple and automated installation is ensured as a result.

According to a preferred refinement of the invention, the connection nipple is made of plastic, especially of an elastomer or soft-elastic thermoplastic. As a result, an axial offset and an angle offset can be compensated in a simple manner.

Preferably, the free end section of the bore is formed by a stepped bore that narrows in diameter, and the free end section of the bore includes in particular an inner circumferential groove. Moreover, in accordance with a preferred exemplified embodiment, the connection nipple includes at least one circumferential bead at a side which is proximal to and engages the free end section of the bore. When inserting the connection nipple into the free end section of the bore, the circumferential bead engages in the inner circumferential groove. As a result, the connection nipple is held securely.

In order to be able to insert the connection nipple into the free end section of the bore in a simple manner, a circumferential bead has a semicircular cross section and a circumferential bead has a trapezoidal cross section. The circumferential bead of semicircular cross section provides a seal of the connection nipple in the bore, and the circumferential bead of trapezoidal cross section is arranged axially on the outside, wherein its cross section decreases radially to the outside. This circumferential bead has a substantially truncated cone shaped configuration and advantageously engages behind a step of the step-shaped bore.

In order to ensure a defined contact of the connection nipple upon the end face of the end section of the bore, the connection nipple has a circumferential stop collar. Moreover, a fluid-tight support in the duct of the lubricating oil supply is rendered possible by providing the connection nipple with a circumferential bead at an end section distal to the rotor shaft.

A faulty insertion of the connection nipple into the rotor shaft is prevented by providing the end section distal to the rotor shaft with a greater diameter than the proximal end section.

Lubricating oil is distributed in the vacuum pump in an optimum manner by configuring the bore as a blind bore and providing the base of the bore with a transverse bore.

BRIEF DESCRIPTION OF THE DRAWING

Further advantages, features and details of the invention are set forth in the sub-claims and the following description which describes in greater detail a particularly preferred exemplified embodiment with reference to the drawing. The features illustrated in the drawing and set forth in the description and the claims may be relevant individually or in any combination.

The drawing shows in.

DETAILED DESCRIPTION OF PREFERRED EMBODIMENTS

Figure 1:
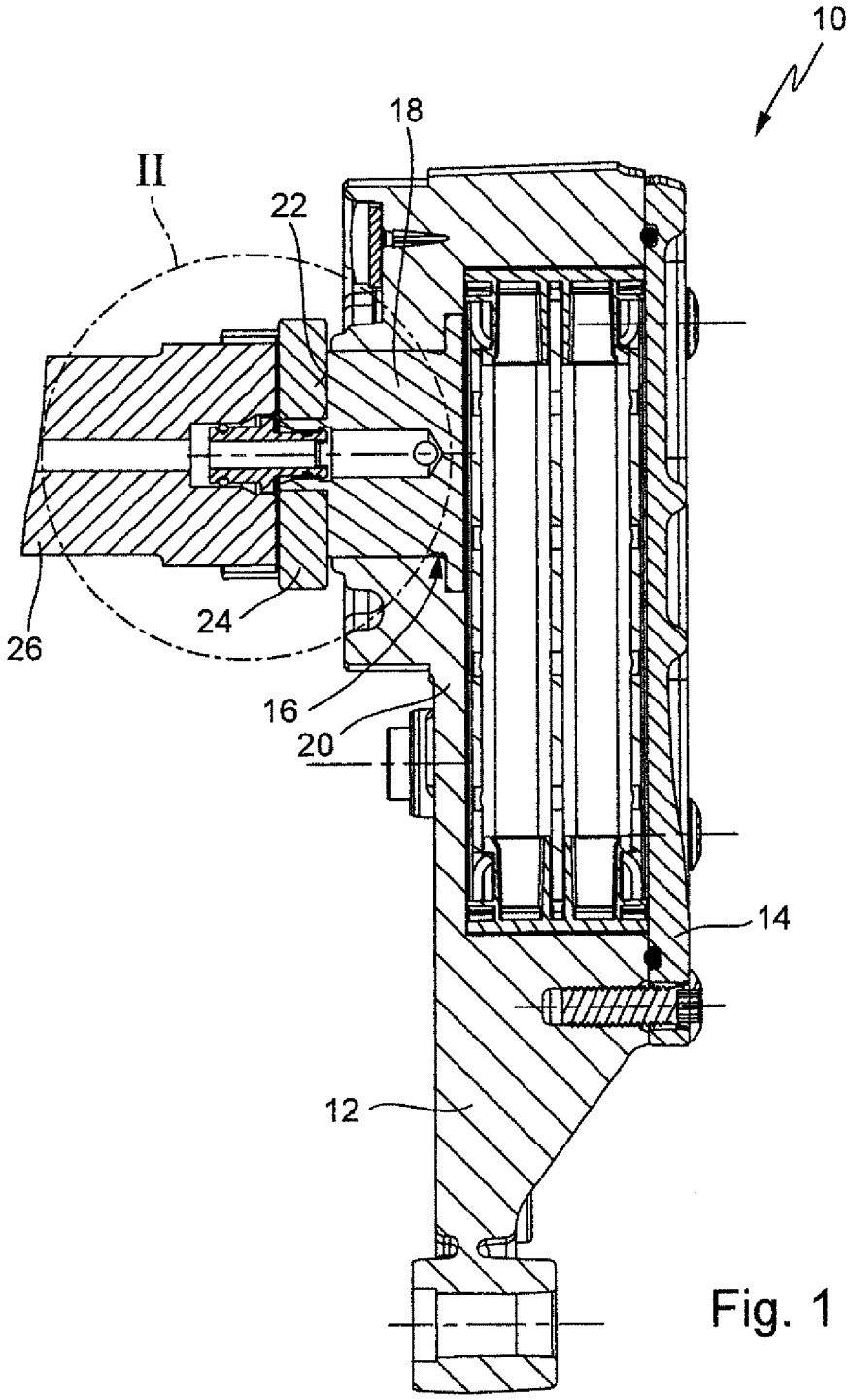
FIG. 1 a longitudinal section through a vacuum pump with hinted drive.

FIG. 1 shows a longitudinal section through a vacuum pump, generally designated by 10 and having a housing 12 which is closed by a housing cover 14. A rotor 16 is rotatably supported in the housing 12 and has a rotor shaft 18 which traverses through the bottom 20 of the housing 12. A clutch 24 bears upon the end face 22 of the rotor shaft 18 to connect a drive 26, e.g. a camshaft, with the rotor shaft 18.

Figure 2:
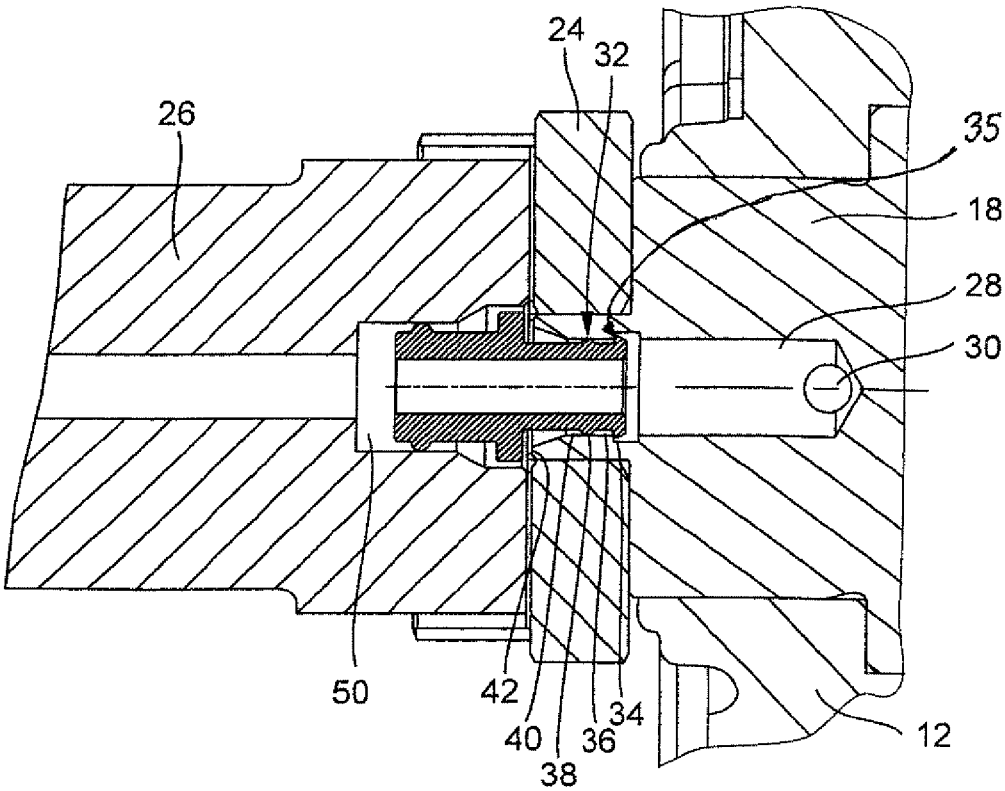
FIG. 2 an enlarged illustration of the detail II according to FIG. 1.

FIG. 2 shows the detail II on an enlarged scale and it can be seen that the rotor shaft 18 has an axial bore 28. This bore 28 is provided for supply of lubricating oil which is dispersed in the housing 12 via a transverse bore 30. The bore 28 has an end section 32 of stepped configuration. Arranged successively from inside to the outside are a first inner circumferential groove 34, a first step 36, a second circumferential groove 38, a second step 40, and an end 42 which widens in the shape of a truncated cone. Seated in this end section is the proximal end section 44 of a connection nipple 46 which is shown enlarged in FIGS. 3 and 4. The distal end section 48 is inserted in a bore 50 via which lubricating oil is supplied.

The connection nipple 46 includes approximately in mid-section a stop collar 52 which abuts an end face 22 of the connection nipple 46 when the latter is inserted in the rotor shaft 18. In this position of the connection nipple 46, a first circumferential bead 54 engages the first circumferential groove 34 and behind the first step 36 against a shoulder 35 (FIG. 2) of the rotor shaft 18 so as to restrain the connection nipple 46 in the bore 28. A second circumferential bead 56 is disposed on the proximal end section 44 which engages the second circumferential groove 38. The second circumferential groove 38 has a greater radius than the second circumferential bead 56 of semicircular cross section so as to establish a substantially linear and thus fluid-tight contact. The cross section of the first circumferential groove 34 is trapezoidal to facilitate insertion of the connection nipple 46 into the bore 28. Ease of insertion is also assisted by the end 42 of the bore 28 as a result of a widening in the shape of a truncated cone. The second circumferential bead 56 may also bear upon a cylindrical section of the bore 28.

Figure 3:
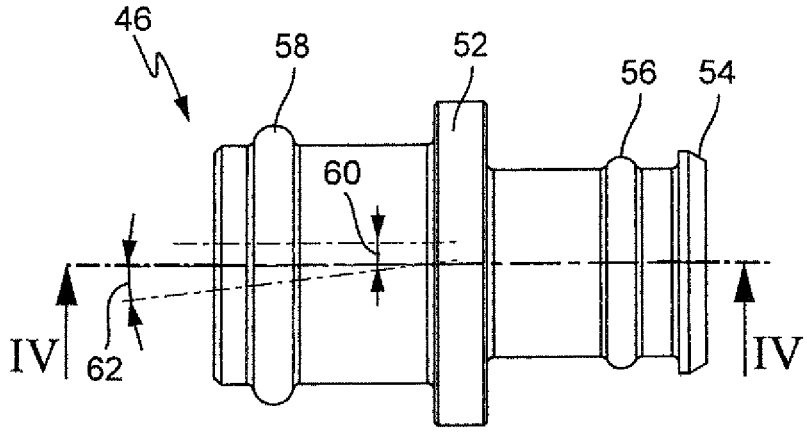
FIG. 3 a side view of the connection nipple.
Figure 4:
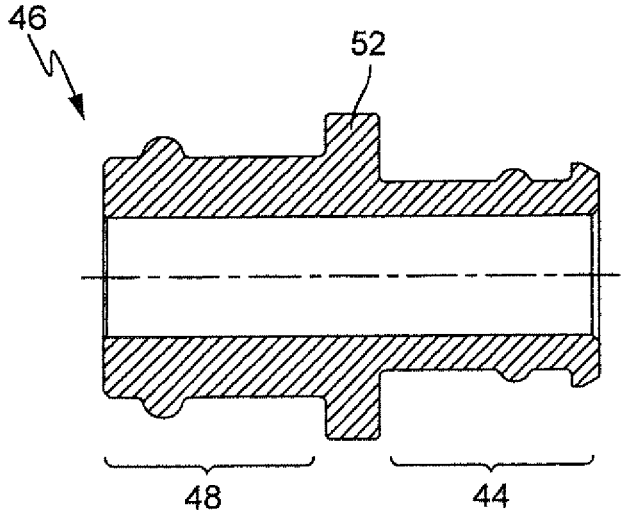
FIG. 4 a longitudinal section IV-IV through the connection nipple according to FIG. 3.

The distal end section 48 of the connection nipple 46 has a third circumferential bead 58 which rests upon the inner circumferential surface of the bore 50 to establish a fluid-tight connection. FIGS. 3 and 4 further show that the diameter of the proximal end section 44 is smaller than the diameter of the distal end section 48.

A connection nipple 46 made of soft-elastic thermoplastic or elastomer is able to easily compensate faulty connections over a long time period and many movement cycles. These faulty connections may involve, e.g., an axle offset 60 and/or an angle flaw 62. The axle offset 60 may amount to up to 1 mm, and the angle flaw 62 may amount to up to 0.5°. Further advantageous is the dampening property of the connection nipple 48 according to the invention. Moreover, there is no need for additional sealing elements, like O-rings or the like because this sealing function is assumed by the circumferential beads 54, 56 and 58.

What is claimed:

1. A vacuum pump, comprising:

a cup-shaped housing;

a housing cover to close the cup-shaped housing;

a rotor eccentrically mounted for rotation in the housing and having a rotor shaft which traverses the cup-shaped housing and is provided with a bore for conducting a lubricating agent;

an external drive to operate the rotor via the rotor shaft; and a connection nipple made of plastic and seated in a free end section of the bore, said free end section of the bore having at least an inner circumferential groove, said connection nipple having a proximal end section which engages in the free end section of the bore and is provided with at least one circumferential bead which engages the inner circumferential groove and rests against a shoulder of the rotor shaft, when the connection nipple is inserted in the free end section of the bore so as to restrain the connection nipple in the bore.

2. The vacuum pump of claim 1, wherein the plastic is elastomer or a soft-elastic thermoplastic.

3. The vacuum pump of claim 1, wherein the free end section of the bore is formed by a stepped bore of narrowing diameter.

4. The vacuum pump of claim 1, wherein the circumferential bead has a semicircular configuration and the circumferential bead has a trapezoidal configuration.

5. The vacuum pump of claim 4, wherein the circumferential bead of trapezoidal configuration is arranged axially on an outside and has a cross section which decreases radially to the outside.

6. The vacuum pump of claim 1, wherein the connection nipple has a circumferential stop collar.

7. The vacuum pump of claim 1, wherein the connection nipple has an end section which is distal to the rotor shaft and provided with a circumferential bead.

8. The vacuum pump of claim 7, wherein the end section of the connection nipple in distal relationship to the rotor shaft has a diameter which is greater than a diameter of the proximal end section.

9. The vacuum pump of claim 1, wherein the bore is configured as a blind bore and has a base provided with a transverse bore.

* * * * *